US011293184B1

(12) United States Patent
Mouriz et al.

(10) Patent No.: US 11,293,184 B1
(45) Date of Patent: Apr. 5, 2022

(54) VENT FOR SHRINK WRAP ROOF COVER

(71) Applicant: STRUCTURAL WRAP, LLC, Miami, FL (US)

(72) Inventors: Christopher M. Mouriz, Miami, FL (US); Spiro Naos, Miami, FL (US); Larry J. Bond, Miami, FL (US)

(73) Assignee: STRUCTURAL WRAP, LLC, Miami, FL (US)

( * ) Notice: Subject to any disclaimer, the term of this patent is extended or adjusted under 35 U.S.C. 154(b) by 0 days.

(21) Appl. No.: 17/473,749

(22) Filed: Sep. 13, 2021

Related U.S. Application Data

(63) Continuation-in-part of application No. 29/781,991, filed on May 3, 2021.

(51) Int. Cl.
*E04D 13/17* (2006.01)
*E04D 5/00* (2006.01)

(52) U.S. Cl.
CPC ..... *E04D 13/17* (2013.01); *E04D 5/00* (2013.01)

(58) Field of Classification Search
CPC ... E04D 13/17; E04D 5/00; E04B 1/70; E04F 13/007; B65D 77/225; B63B 59/045; E04G 23/0281
See application file for complete search history.

(56) References Cited

U.S. PATENT DOCUMENTS

2020/0055578 A1* 2/2020 Gust ..... B63B 59/045

* cited by examiner

*Primary Examiner* — Andrew J Triggs
(74) *Attorney, Agent, or Firm* — Mark Terry

(57) ABSTRACT

A vent for use in a membrane covering a roof comprises a tubular element having an inner volume, a first end and a second end, a piercing structure located at the first end of the tubular element, a first opening located at a bottom of the tubular element that provides access to the inner volume, a second opening located at the second end of the tubular element that provides access to the inner volume, and a clip located at a top of the tubular element.

20 Claims, 6 Drawing Sheets

VENT FOR SHRINK WRAP ROOF COVER

CROSS-REFERENCE TO RELATED APPLICATIONS

This patent application is a continuation in part of, and claims priority to, design patent application 29781991 filed on May 3, 2021. The subject matter of design patent application 29781991 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the field of residential and commercial structural maintenance and, more specifically, relates to the field of roof maintenance for residential and commercial structures.

BACKGROUND

Maintenance is the process of ensuring that buildings and structures retain a good appearance and operate at optimum efficiency. Inadequate maintenance can result in decay, degradation and reduced performance and can affect health and threaten the safety of users, occupants and others in the vicinity. Building structure, and roofs in particular, are regularly subjected to harsh conditions including wind, rain, snow, heat, cold, and storms. Said conditions can cause damage to the roof, as well as the interior of the structure. For these reasons, roofs require regular maintenance to maintain optimum efficiency and continue to accomplish their design goals.

When roofs suffer significant damage, however, significant construction or refurbishing services may be necessary. This may require a long period of time to accomplish, as contractors must be found and assigned to the job, permits must be obtained, and money must be allocated and transferred. During this period time, the roof cannot be left unattended, as the roof the contents of the structure may suffer further damage. In these situations, therefore, temporary remedial or protective measures are necessary.

Various approaches to this problem have been proposed. A well-known approach to this problem is to attach a temporary water-impermeable membrane, such as shrink wrap, to the exterior of the roof to prevent water from penetrating the roof while it remains damaged. One of the problems associated with this approach is that the roof is completely covered and does not allow for the free flow of gases, which is necessary for plumbing vents, attic vents or other vents. A plumbing vent or plumbing vent pipe is designed to regulate the air pressure throughout a plumbing system and helps remove gas and odors common with a plumbing system, allowing fresh air into the system to help keep the building from smelling and to help water flow smoothly down the drain and out of the building. Attic vents allow cool air to enter the attic and allow hot air to escape.

When plumbing vents, attic vents or other vents are obstructed and gases are not allowed to flow freely therethrough, negative effects may occur, such as improper odors, gas buildup, clogged pipes, overheated attics, etc.

Therefore, a need exists to overcome the problems with the prior art as discussed above, and particularly for a more efficient and effective way of applying temporary remedial or protective measures onto a damaged roof.

SUMMARY

An apparatus and system and method for use in a membrane covering a roof is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a vent for use in a membrane covering a roof comprises a tubular element having an inner volume, a first end and a second end, a piercing structure located at the first end of the tubular element, a first opening located at a bottom of the tubular element that provides access to the inner volume, a second opening located at the second end of the tubular element that provides access to the inner volume, and a clip located at a top of the tubular element.

In another embodiment, a system includes a membrane covering a roof, and a vent comprising a tubular element having an inner volume, a first end and a second end, a piercing structure located at the first end of the tubular element, a first opening located at a bottom of the tubular element that provides access to the inner volume, a second opening located at the second end of the tubular element that provides access to the inner volume, and a clip located at a top of the tubular element.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
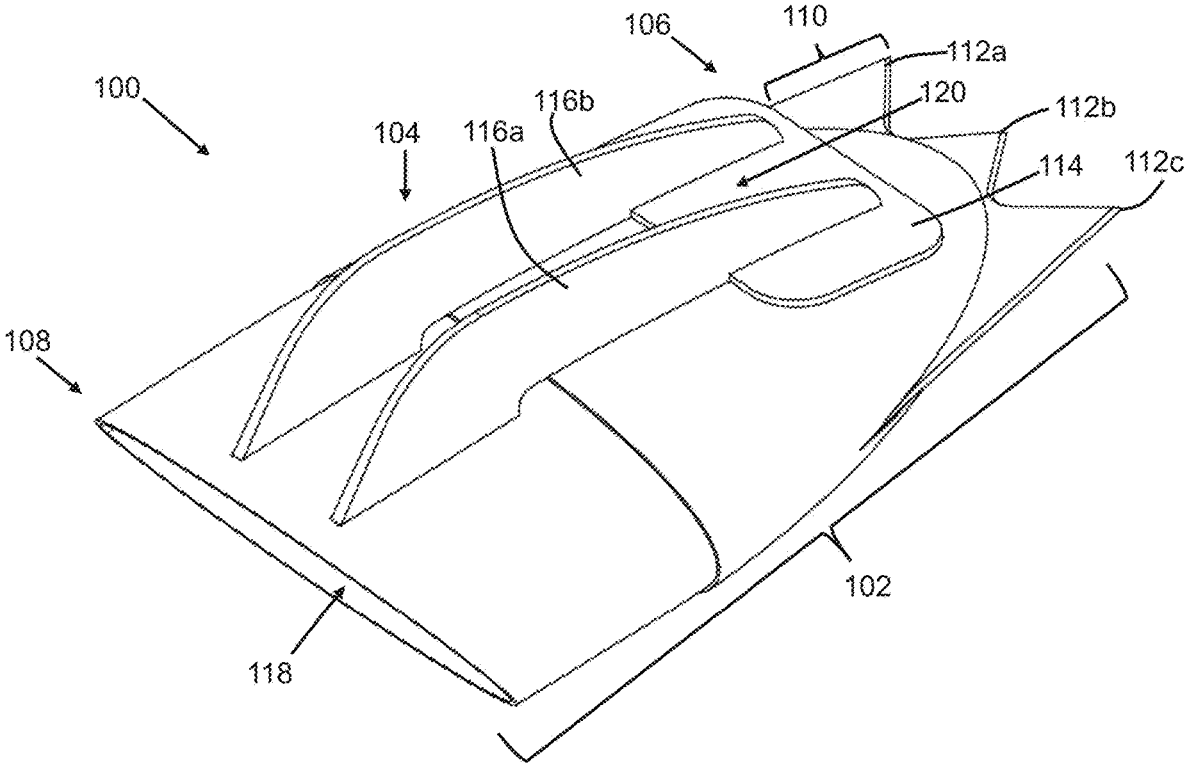
FIG. 1 is a top perspective view of an exemplary vent for use in a membrane covering a roof, according to an example embodiment.

The following detailed description refers to the accompanying drawings. Wherever possible, the same reference numbers are used in the drawings and the following description to refer to the same or similar elements. While embodiments of the claimed subject matter may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing an economic, user-friendly and effective way of ventilating plumbing vents, attic vents or other vents on a damaged roof, when the roof has been completely covered by an impermeable membrane. The claimed subject matter is further easy to learn for workers and time-saving to implement. The claimed subject matter further improves over the prior art by providing an instrument for making a hole in the impermeable membrane over the plumbing vents, attic vents or other vents before inserting the claimed vent. The claimed subject matter further improves over the prior art by providing a clip that secures the vent to the impermeable membrane over the plumbing vents, attic vents or other vents.

The accompanying drawings, which are incorporated in and constitute a part of this disclosure, illustrate various example embodiments. The water impermeable membrane disclosed herein may shrink when heat is applied. Namely, when heat is applied to the water impermeable membrane, the material shrinks tightly over whatever it is covering. Further, when heat is applied to the water impermeable membrane, the membrane may become partially liquid or tacky and may meld with a membrane of the same type. That is, when two pieces of said membrane are placed adjacent to one another and heat is applied, the two pieces of the membrane may meld together and become one integrated portion of water impermeable membrane. The water impermeable membrane may be used in a variety of thicknesses, clarities, strengths and shrink ratios. The water impermeable membrane may comprise polyolefin and may be a material made up of polymer plastic film. Polyolefin is a type of polymer produced from a simple olefin (also called an alkene) as a monomer. Other examples of materials used for the water impermeable membrane include PVC, polyethylene, polypropylene, EP/EVA/copolyester/EVA/EP (where EP is ethylene-propylene and EVA is ethylene-vinyl acetate copolymer) and other compositions.

FIG. 1 references a vent 100 for use in a membrane covering a roof. The vent 100 is unique in providing a detachable/portable venting means adapted to penetrate an impermeable membrane 904, such as shrink wrap, that completely encapsulates a damaged roof 902. The vent 100 is configured to penetrate the impermeable membrane 904, approximately above a permanent vent or outlet, such as a plumbing vent, an attic vent, and other vents that form in the roof. The vent 100 aligns into fluid communication with the fixed vent and securely clamps to the impermeable membrane 904, so as to enable unmanned venting of the gas or fluid 1100. Put another way, the vent 100 has the capacity to penetrate the impermeable membrane 904 from a first end 106, receive the gas or fluid through a first opening, carry the gas 1100 through the inner volume of a tubular element 102, and finally disperse the gas 1100 through a second opening, away from the roof.

Figure 2:
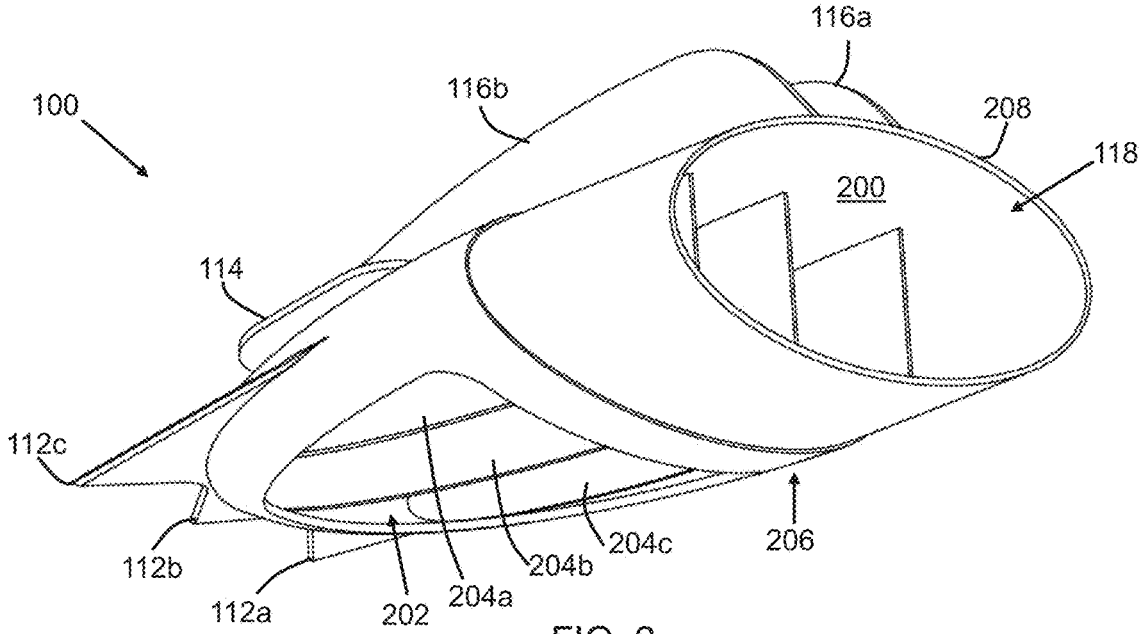
FIG. 2 is a bottom perspective view of the vent shown in FIG. 1, according to an example embodiment.

Looking now at FIG. 2, the vent 100 comprises a tubular element 102 having an inner volume 200. In some embodiments, the tubular element 102 defines an elliptical cross section. Such an elliptical shaped volume provides sufficient space for venting heavier gases, including toxic gases. In other embodiments, the tubular element 102 defines a substantially semicircular shape when viewed from above, such that the first end 106 is substantially rounded at the terminal edges.

Further, the use of an elliptical cross section serves to create a low profile that enables the tubular element 102 to have partial entry between the impermeable membrane 904 and the damaged roof 902. For example, a 3" long, and 6" high tubular element is sized to easily slide between the impermeable membrane 904 and the damaged roof 902, while still providing sufficient volume for carrying away the vented gas or fluid 1100. However, in alternative embodiments, the tubular element 102 may have more geometric surfaces, including an elongated rectangle, an elongated triangle, or irregular shapes.

Figure 3:
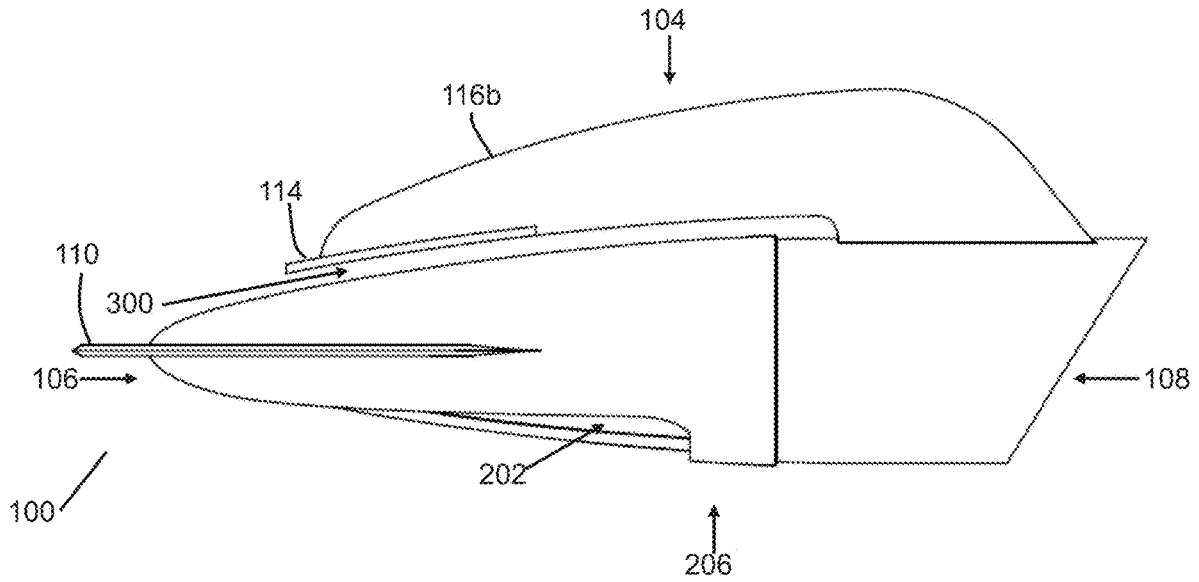
FIG. 3 is an elevated right-side view of the vent shown in FIG. 1, according to an example embodiment.

Looking now at FIG. 3, the tubular element 102 defines a first end 106 and an opposing second end 108. In general, the first end 106 serves as the inlet for the vented gas, and the second end 108 is the gas outlet during the venting process. The ends 106, 108 are in fluid communication through an inner volume 200 of tubular element 102. Put another way, the first end 106 fits snugly between the impermeable membrane 904 and the roof 902 to receive the gas 1100 from the fixed vent in the roof; and the second end 108 projects outwardly from the impermeable membrane 904 to disperse the gas 1100, away from the roof 902 (See FIG. 11).

Figure 4:
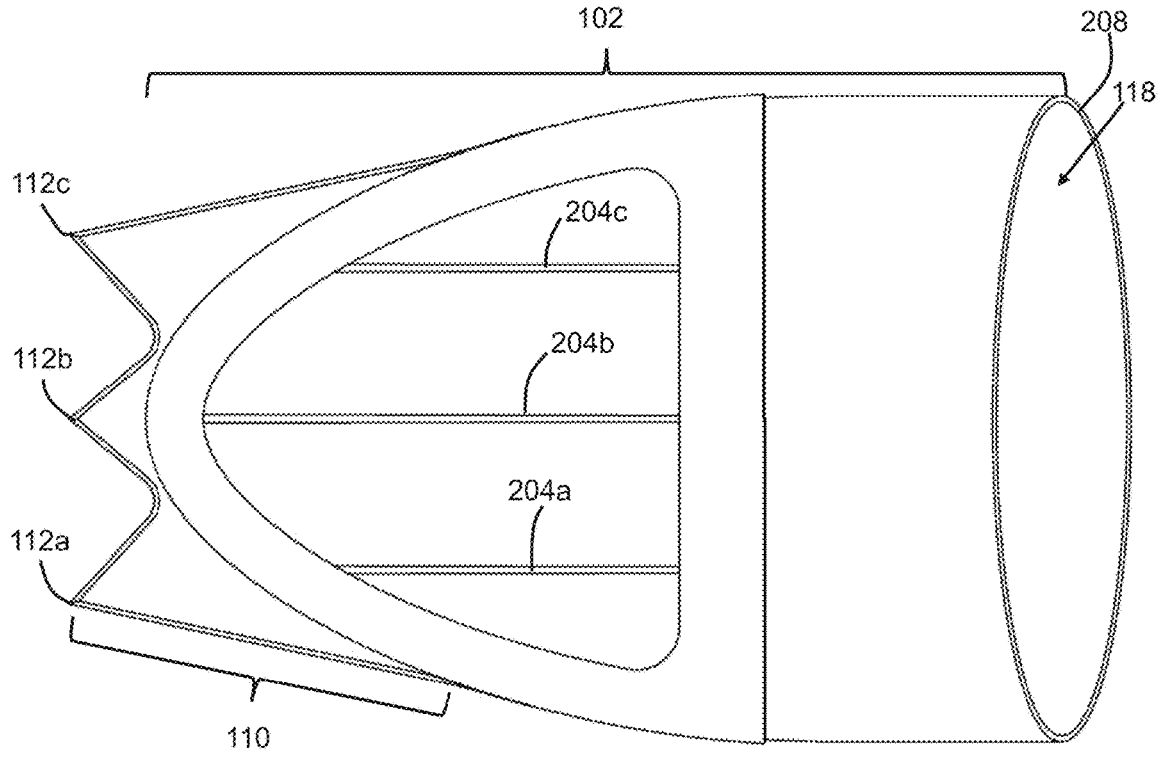
FIG. 4 is a bottom view of the vent shown in FIG. 1, according to an example embodiment.

As illustrated in FIG. 4, the tubular element 102 also includes a longitudinal axis, whereby the tubular element is generally elongated. A first opening 202 forms in the first end 106, at a bottom 206 of the tubular element 102. The bottom 206 of tubular element 102 orients to face the roof 902. The first opening 202 is sized and dimensioned to provide access to the inner volume 200.

Figure 5:
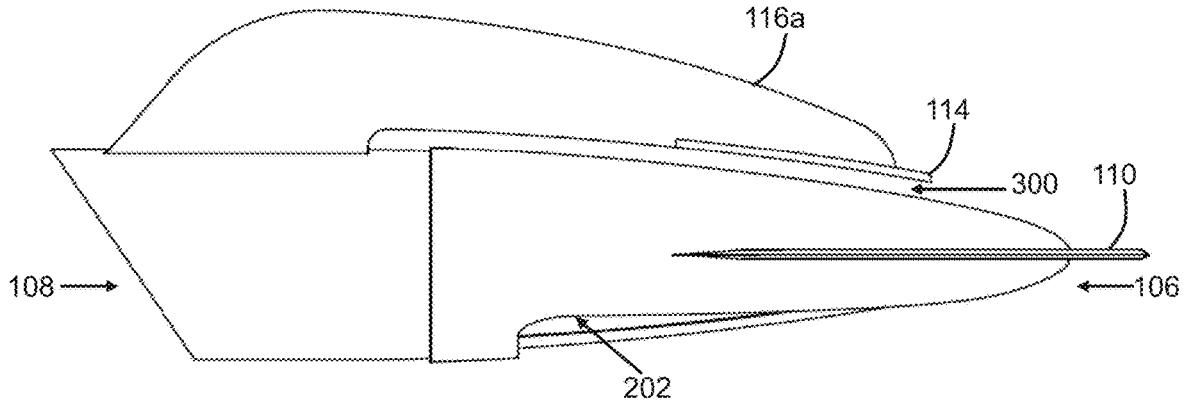
FIG. 5 is an elevated left side view of the vent shown in FIG. 1, according to an example embodiment.

The second opening 118 generally follows the cross-sectional shape of the elliptical tubular element 102. Further, the second opening 118 defines a brim 208, or terminal edge. The brim 208 is configured to form a plane that intersects the longitudinal axis at about a 45° angle. As FIG. 5 shows, the 45° angle allows the top of the tubular element 102 to extend further than the bottom 206 of the tubular element 102, at the brim 208. This angled configuration at the brim 208 helps funnel the vented gas 1100 downwardly, and along the top surface of the impermeable membrane 904.

Figure 6:
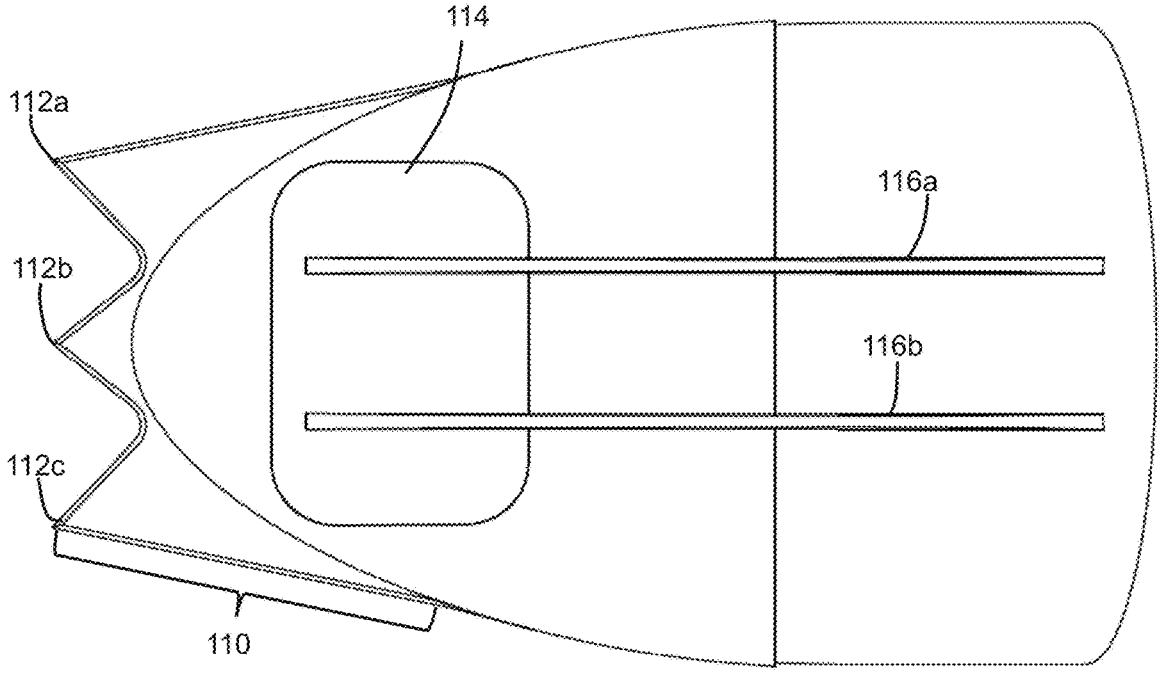
FIG. 6 is a top view of the vent shown in FIG. 1, according to an example embodiment.

As discussed above, the impermeable membrane 904 has a thickness and durability that prevents tearing, so as to securely encapsulate the damaged roof. Thus, to introduce the first end 106 of the tubular element 102 between the impermeable membrane 904 and the roof 902 for venting purposes, a piercing structure 110 is utilized. The piercing structure 110 is disposed at the first end 106 of the tubular element 102 (See FIG. 6).

As the name implies, the piercing structure 110 is configured to enable a user to forcibly urge the first end 106 of tubular element 102 through the impermeable membrane 904, approximately aligning with the fixed vent in the roof. In one non-limiting embodiment, the piercing structure 110 is a generally flat structure that projects from a central area, and beyond the first end 106 for the tubular element 102. The piercing structure 110 comprises one or more pointed protrusions 112*a-c*. In one non-limiting embodiment, three pointed protrusions 112*a*, 112*b*, 112*c* project from the terminus of the piercing structure 110. The piercing structure 110 is configured to enable a user to forcibly urge the first end 106 of tubular element 102 through the impermeable membrane 904 and make a hole or orifice in the membrane.

FIG. 5 shows that the tubular element 102 includes a longitudinal axis that extends from first end 106 to second end 108. The opening 118 further comprises a circular or elliptical brim 208 in a plane that intersects the longitudinal axis at about a forty-five-degree angle. Using this orientation of the brim, rain and other water from the ambient environment cannot fall into the device 100 and onto the residential structure.

Figure 7:
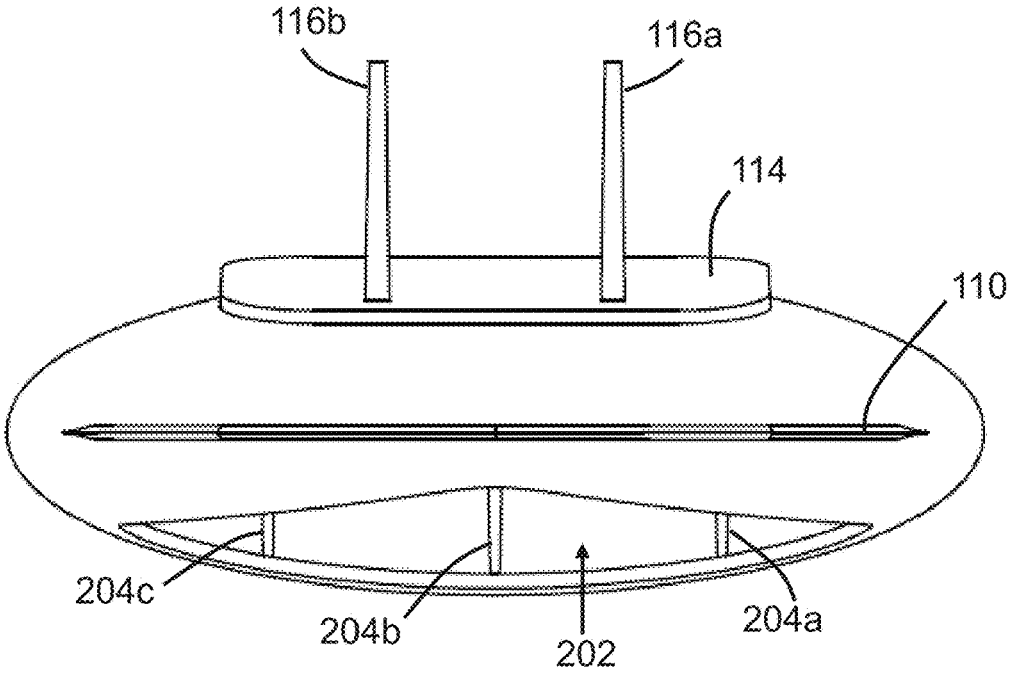
FIG. 7 is rear view of the vent shown in FIG. 1, according to an example embodiment.

Looking now at FIG. 7, the tubular element 102 defines a first opening 202 located at a bottom 206 of the tubular element 102. The first opening 202 provides access to the vented gas 1100 into the inner volume 200 of tubular element 102. The formation of first opening 202 at the bottom 206 of tubular element is a structural advantage that allows tubular element to sit directly on top of fixed vent ion roof. This facilitates aligning the first opening with the fixed vent in roof, so as to enable fluid communication therebetween.

As shown in FIG. 2, one or more flanges 204*a-c* are disposed in a parallel, spaced-apart relationship within the inner volume 200 of the tubular element 102. In one non-limiting embodiment, the one or more flanges 204*a-c* comprise three flanges 204*a-c* that are arranged perpendicularly to the top 104 of the tubular element 102. The three flanges 204*a*, 204*b*, 204*c* extend in a parallel, spaced-apart relationship through the inner volume 200 of the tubular element 102. The flanges are configured to segregate and guide the vented gas towards the second opening 118 for dispersing away from the roof 902.

To disperse the vented gas, the tubular element 102 defines a second opening 118 that forms at the second end 108 of the tubular element 102. The second opening 118 is sized and dimensioned to enable dispersion of the gas passing through the inner volume 200. In one possible embodiment, the second opening 118 comprises a substantially semicircular shape. This semicircular shape is efficacious for enabling the second opening 118 to optimize dispersion of the vented gas.

Once the first end 106 of the tubular element 102 is snugly fitted between the impermeable membrane 904, a continuous, uninterrupted venting can occur without supervision.

Figure 8:
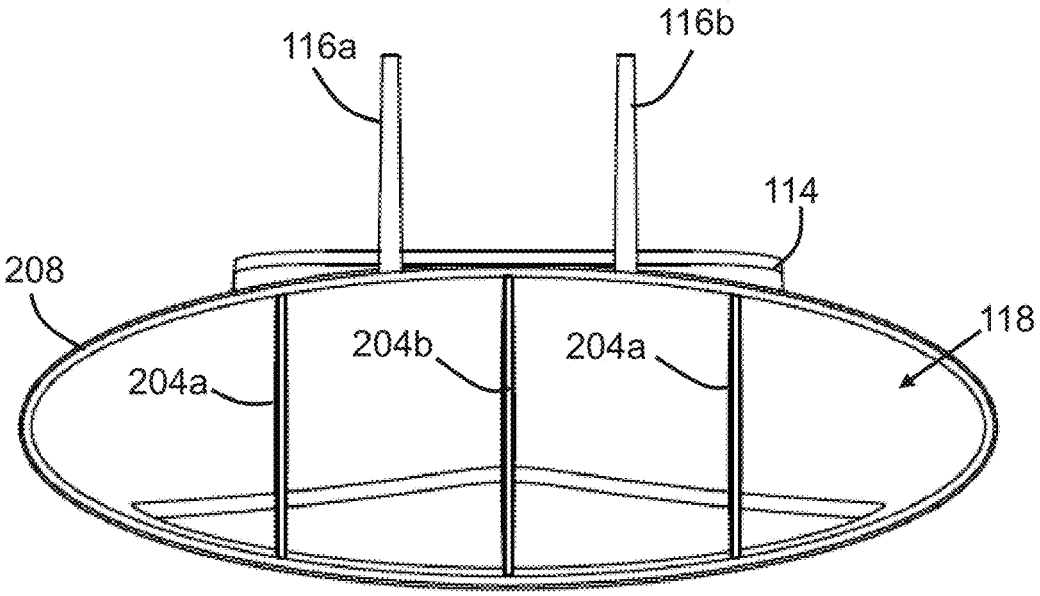
FIG. 8 is a front view of the vent shown in FIG. 1, according to an example embodiment.

As FIG. 8 shows, the clip 114 is a planar element arranged parallel to the top 104 of the tubular element 102. In this arrangement, the clip 114 is spaced-apart from the top of tubular element 102. The clip 114 is utilized to fasten the tubular element 102 to the impermeable membrane 904. Use of such a clamping means helps maintain fluid communication between the fixed vent in the roof and the inner volume 200 of the tubular element 102.

In some embodiments, the clip 114 comprises one or more arms 116*a*, 116*b* that couple to the top 104 of the tubular element 102, at the second end 108 of the tubular element 102. The clip 114 is located at the end of the arms 116*a*, 116*b*. Each of the arms 116*a*, 116*b* comprises a planar element arranged perpendicularly to the top 104 of the tubular element 102. The arms 116*a*, 116*b* extend toward the first end 106 of the tubular element 102, from the top 104 of the tubular element 102. In one embodiment, two arms 116*a*, 116*b* extend toward the first end 106 of tubular element 102. However, in alternative embodiments, more than two arms may be used. At the end of the arms 116*a*, 116*b* is a plate 120.

As FIG. 3 illustrates, a uniform gap 300 forms between the two arms 116*a*, 116*b* and the top 104 of the tubular element 102. The gap 300 is sized and dimensioned to introduce the impermeable membrane 904 therein. In some embodiments, the arms 116*a-b* may have a mechanical tension that biases the clip 114 downwardly, towards the top 104 of the tubular element 102, creating a clamping effect. The arms 116*a-b* can be forcibly raised to enable introduction of the impermeable membrane 904 and the roof 902 into the gap 300. Once the tubular element positions into fluid communication with the fixed vent in the roof, the arms 116*a-b* may be released to clamp the clip 114 onto the impermeable membrane 904.

Figure 9:
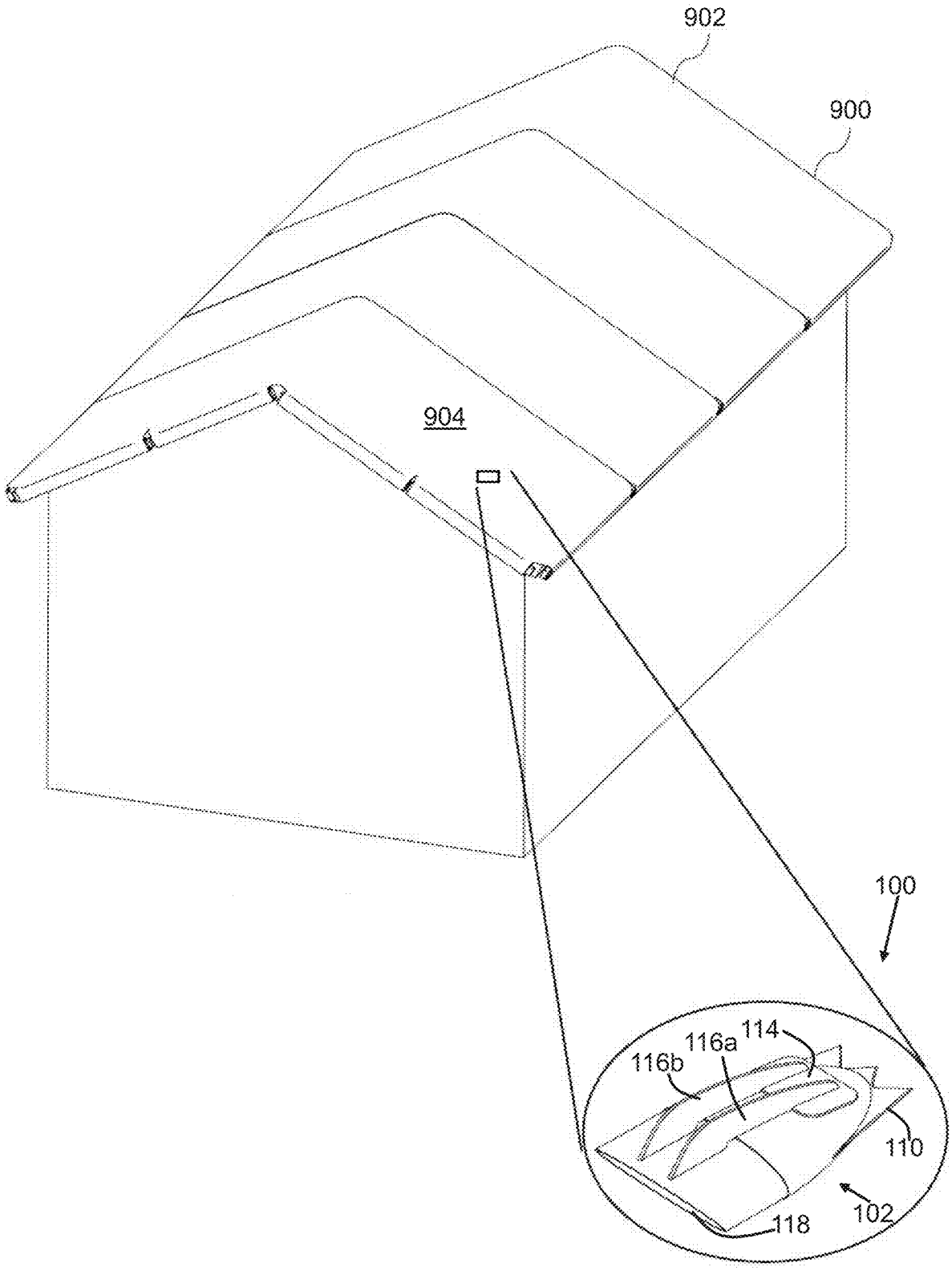
FIG. 9 is an illustration of a perspective view of a residential structure with a damaged roof, showing the shrink wrap completely applied and the vent for roof cover, according to an example embodiment.

FIG. 9 is an illustration of a perspective view of the residential structure 900 with a damaged roof 902, showing an impermeable membrane 904, such as shrink wrap, completely applied to the damaged roof, according to an example embodiment. FIG. 9 shows that multiple rolls of the impermeable membrane 904 have been draped on top of the damaged roof 902 of the residential structure 900 in the same direction and the sides of each unrolled strip of impermeable membrane 904 have been melded to adjacent unrolled strips of impermeable membrane, such that the entire roof 902 is covered in the impermeable membrane. FIG. 9 shows that construction material on the eaves of the roof has been wrapped in the end of the unrolled strip in a clockwise direction so that the open end of the roll faces downwards. This reduces or eliminates the pooling of water in the open end of the roll.

Figure 10:
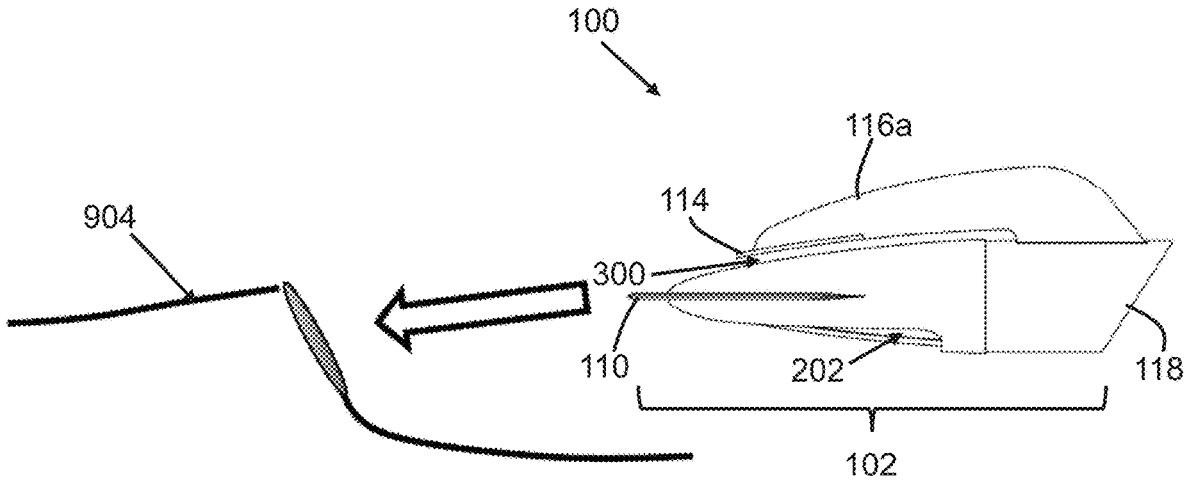
FIG. 10 is an illustration of a perspective view of a residential structure with a damaged roof, as the proposed system and method for temporary protection of a damaged roof is applied, according to an example embodiment.
Figure 11:
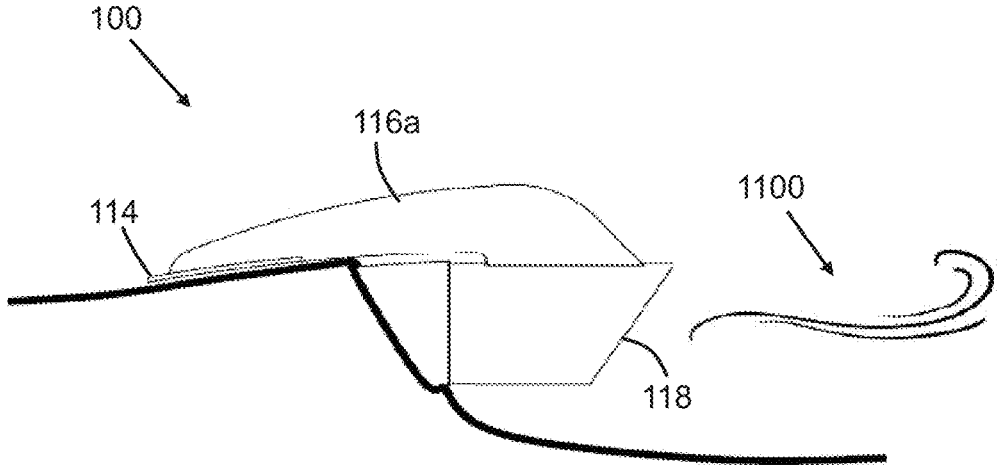
FIG. 11 is an illustration of the vent used on a roof cover completely applied to a residential structure, according to an example embodiment.

FIGS. 10-11 illustrate the operation of a vent 100 in venting gases from inside a residential house 900 through an impermeable membrane 904 that covers the roof 902. As illustrated a first end of the tubular element 102 orients towards the roof, approximately above the fixed vent in the roof (FIG. 10). In one exemplary operational process, the impermeable membrane 904 can be raised and formed to better receive the first end of the tubular element 102. The piercing structure 110 at the first end is positioned to be forcibly urged through the impermeable membrane 904. FIG. 10 shows that a hole or orifice has been made in the impermeable membrane 904 by the piercing structure 110.

Looking now at FIG. 11, the first end of tubular element 102 has been introduced between the impermeable membrane 904 and the roof 902 via the hole or orifice made in the impermeable membrane 904 by the piercing structure 110. The vent 100 is in alignment and fluid communication with the fixed vent. The gas or fluid may then flow through the first opening at the bottom of the tubular element, through the inner volume, before dispersing out the second opening at the second end of the tubular element. Once the venting is completed, the tubular element 102 may be removed, and if necessary, the impermeable membrane 904 can be patched to reseal the roof contained therein. The vent 100 may then be applied to another fixed vent on the same roof or used universally across different roofs.

FIG. 11 shows that the clip 114 is utilized to fasten the tubular element 102 to the impermeable membrane 904 and the clip lays on top of the membrane. FIG. 11 also shows the gas 1100 venting through the inner volume of tubular element 102, and the gas 1100 dispersing through the second opening, away from the roof.

Embodiments may be described above with reference to functions or acts, which comprise methods. The functions/acts noted above may occur out of the order as shown or described. For example, two functions/acts shown or described in succession may in fact be executed substantially concurrently or the functions/acts may sometimes be executed in the reverse order, depending upon the functionality/acts involved. While certain embodiments have been described, other embodiments may exist. Further, the disclosed methods' functions/acts may be modified in any manner, including by reordering functions/acts and/or inserting or deleting functions/acts, without departing from the spirit of the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A vent for use in a membrane covering a roof, comprising:

a) a tubular element having an inner volume, a first end and a second end;

b) a piercing structure located at the first end of the tubular element;

c) a first opening located at a bottom of the tubular element that provides access to the inner volume;

d) a second opening located at the second end of the tubular element that provides access to the inner volume; and e) a clip located at a top of the tubular element.

2. The vent of claim 1, wherein the tubular element further comprises an elliptical cross section.

3. The vent of claim 2, wherein the tubular element further comprises a substantially semicircular shape when viewed from above, wherein the first end is substantially rounded.

4. The vent of claim 3, wherein the piercing structure further comprises one or more pointed protrusions.

5. The vent of claim 4, wherein the tubular element includes a longitudinal axis and wherein the first opening further comprises a brim having a plane that intersects the longitudinal axis at about a forty-five-degree angle.

6. The vent of claim 5, wherein the second opening comprises a substantially semicircular shape.

7. The vent of claim 6, wherein the clip comprises one or more arms coupled to the top of the tubular element at the second end, wherein the one or more arms extend toward the first end with a uniform gap between the one or more arms and the top of the tubular element.

8. The vent of claim 7, wherein each of the one or more arms comprises a planar element arranged perpendicularly to the top of the tubular element.

9. The vent of claim 8, further comprising a clip end located at an end of the one or more arms.

10. The vent of claim 9, wherein the clip end is a planar element arranged parallel to the top of the tubular element.

11. The vent of claim 7, wherein the clip comprises two arms coupled to the top of the tubular element at the second end, wherein the two arms extend toward the first end with a uniform gap between the two arms and the top of the tubular element.

12. The vent of claim 11, wherein each of the two arms comprises a planar element arranged perpendicularly to the top of the tubular element.

13. The vent of claim 12, further comprising a clip end located at an end of the two arms.

14. The vent of claim 13, wherein the clip end is a planar element arranged parallel to the top of the tubular element.

15. The vent of claim 7, further comprising one or more flanges located within the inner volume.

16. The vent of claim 15, wherein the one or more flanges comprises three flanges arranged perpendicularly to the top of the tubular element.

17. A vent for use in a membrane covering a roof, comprising:

a) a tubular element having an inner volume, a first end and a second end;

b) a piercing structure located at the first end of the tubular element;

c) a first opening located at a bottom of the tubular element that provides access to the inner volume;

d) an elliptical opening located at the second end of the tubular element that provides access to the inner volume; and e) a clip located at a top of the tubular element;

f) wherein when the first end of the of the tubular element is inserted into the membrane, the clip lays on top of the membrane, the first opening is located inside of the membrane and the elliptical opening is located outside of the membrane.

18. The vent of claim 17, wherein the tubular element further comprises a substantially semicircular shape when viewed from above, wherein the first end is substantially rounded.

19. The vent of claim 18, wherein the piercing structure further comprises one or more pointed protrusions.

20. The vent of claim 19, wherein the tubular element includes a longitudinal axis and wherein the first opening further comprises a brim having a plane that intersects the longitudinal axis at about a forty-five-degree angle.

* * * * *